United States Patent [19]

Johnson

[11] 3,932,906

[45] Jan. 20, 1976

[54] COLLAPSIBLE BOAT

[76] Inventor: Walter E. Johnson, 21 Colorados Drive, Millbrae, Calif. 94030

[22] Filed: May 10, 1974

[21] Appl. No.: 468,975

[52] U.S. Cl. ..... 9/2 C; 9/2 F
[51] Int. Cl.[2] ..... B63B 7/06
[58] Field of Search ..... 9/2 C, 2 R, 2 F

[56] References Cited

UNITED STATES PATENTS

| | | | |
|---|---|---|---|
| 1,227,247 | 5/1917 | Cox | 9/2 C |
| 2,111,555 | 3/1938 | Clark | 9/2 C |
| 2,504,256 | 4/1950 | Dittrich | 9/2 C |

FOREIGN PATENTS OR APPLICATIONS

| | | | |
|---|---|---|---|
| 529,700 | 11/1904 | United Kingdom | 9/2 C |

*Primary Examiner*—Trygve M. Blix
*Assistant Examiner*—Gregory W. O'Connor
*Attorney, Agent, or Firm*—Julian Caplan

[57] ABSTRACT

A boat collapses to two planar thin layers of material which are preferably hinged across the middle to fold into a four-layer, conveniently transportable unit. The bottom layer has a fold at the prow but is otherwise unitary. The top layer consists of several pieces, namely, a major portion which extends from end to end and along the sides; four gunwale-forming panels hinged to the major portion longitudinally toward either end of the middle fold on either side; and two seat-forming panels hinged to the major portion transversely and each spaced toward either end. The prow of the top layer is formed with a fold similar to that in the bottom. When the boat is erected, the folds cause the prow to assume a conical shape. The gunwale-forming panels pivot downward and are latched causing the top major layer to be spaced above the bottom layer and causing the bottom to be convex. At front and rear, immediately beyond each seat-forming panel is a transverse, air-tight membrane sealed to the top major portion and to the bottom. As the boat is erected, these membranes form front and rear buoyancy chambers, there being valves in the top major portion to enable air to enter the chambers and be sealed therein. The stern consists of a flexible membrane which is about vertical when erected. An outboard motor support may be pivoted to the uppermost stern panel and is self-erecting.

8 Claims, 14 Drawing Figures

COLLAPSIBLE BOAT

This application is the subject to a disclosure document No. 013099, filed Aug. 30, 1972.

This invention relates to a new and improved collapsible boat.

A principal feature of the invention is the fact that it comprises substantially only two sheets of flexible material such as aluminum or other lightweight metal, plywood, composition board, or plastic, either fiber reinforced or plain, the mating edges of the material being hinged together in certain locations and being fastened together by a flexible high strength tape in other locations. In addition, an air-tight membrane is provided in the front and rear to form air-tight buoyancy compartments. Accordingly, the invention is simple and inexpensive to manufacture.

Another feature of the invention is the fact that in erected position the flat bottom becomes curved and the flat top and bottom are curved and folded to form a conical bow.

Another feature of the invention is that in flattened condition the boat may be folded ih half along its transverse middle for easy storage. Although not illustrated here, it will readily occur to one skilled in the art that the boat may be also folded into quarters if desired.

A further feature of the invention is that when erected the boat is very rigid with excellent hydrodynamic design and stability. The boat is suitable for use with a sail or outboard motor if desired.

One of the features of the invention is the fact that upward extending pleats are formed in the top and bottom prow panel. These pleats, triangular in shape, accommodate excess material in forming the conical shape. They also strengthen the prow.

Another feature of the invention is the fact that there are two large buoyancy chambers in the front and rear, respectively, sealed from the atmosphere, thereby providing safety for the boat and also assisting in forming the curved bottom, conical prow and vertical stern. The buoyancy tank makes the boat self-emptying merely by rolling the capsized boat over.

Still another feature of the invention is the fact that the stern is provided with a self-erecting motor mount for an outboard motor.

Another feature of the invention is the strength of the boat. Thus gunwales which are triangular in cross-section are formed along each side of the cockpit to provide side walls for the cockpit and also to greatly strengthen the boat at the middle. Similarly, at each end of the cockpit are seat backs which are hinged to the top front and rear panels of the boat and secured in position by means of straps/or by friction. The gunwale forming panels and seat back forming panels define the cockpit and also help in maintaining the shape of the boat in erected position and assist in rigidifying the erected boat. Nevertheless, when the boat is collapsed, the panels which form the gunwales and seat backs fold flat and the gunwale forming panels are also hinged at the middle of the boat so that the collapsed boat may be folded in half.

An optional feature of the boat is the provision of a transparent window in one, or both, of the bottom forming panel.

Another feature of the invention is the fact that in collapsed condition the boat may be used as a wind break, sun shade or tent.

Other objects of the present invention will become apparent upon reading the following specification and referring to the accompanying drawings in which similar characters of reference represent corresponding parts in each of the several views.

Figure 1:
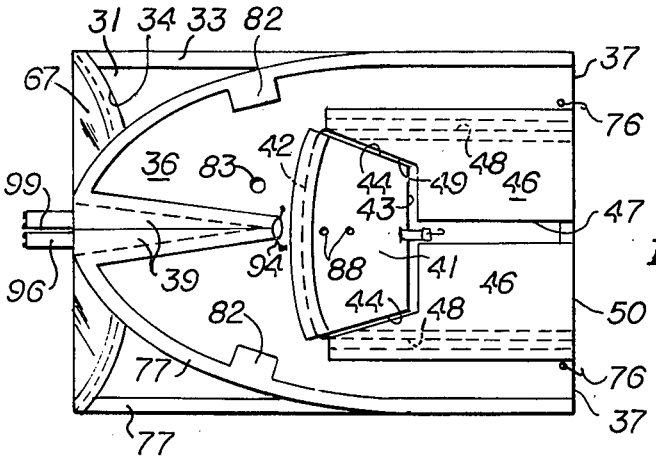
FIG. 1 is a top plan view of the boat collapsed and folded.

As shown in FIGS. 1–4, the boat of the present invention consists of various strong, thin, lightweight panels, hereinafter described in detail, which may be collapsed flat and then folded in half along the middle of the boat. The materials of which the various panels are formed may be a lightweight metal, such as aluminum, or may be a composition such as plywood, compressed board (masonite) or a plastic, preferably suitably reinforced. Front and bottom panel 21 has a straight transverse middle edge 22 and side edges 23 which extend parallel from edge 22 and then curve inwardly at the front. The front of panel 21 is cut away to accommodate a pair of triangular bottom prow wedges 24 which meet along the longitudinal mid-section of the bottom and extend from the prow about one-half the length of the panel 21. As an optional feature, a rectangular transparent panel 26 may be set into panel 21 to make the bottom of the boat transparent.

Rear bottom panel 31 has a transverse middle edge 32 which abuts edge 22. The side edges 33 are preferably parallel throughout the length of the boat. The rear edge 34 is inwardly concave (see FIG. 4).

Top front panel 36 in its peripheral shape is complementary to panel 21. It has a straight transverse middle edge 37 which overlies edge 32 and side edges 38 which extend forwardly parallel to each other and then curve inwardly. The center of the prow end of panel 36 is cut away to accommodate top prow wedge forming panels 39 which are similar in function to panels 24. The middle of the rearward half of panel 36 is cut away, as is best shown in FIG. 1, to provide two parallel lines extending forwardly from edge 37 (indicated by reference numeral 48) and joined by curved line indicated by reference numeral 42. The material cut out is used to form panel 41 and two panels 46. Panel 41 is a front seat panel which has a curved forward edge 42 and straight inwardly-rearwardly converging side edges 44 and a straight bottom edge 43.

Each gunwale-forming front panel 46 has a straight longitudinal inner edge 47, the two inner edges 47 being spaced apart, as best shown in FIG. 1, a short distance in the collapsed condition of the boat and longitudinal outer edges 48 spaced slightly inwardly from edges 38 and an irregular front edge 49, which is generally parallel to edges 43 and 44 and spaced slightly therefrom. The transverse middle edge 50 of panel 46 is a continuation of edges 37 on either side thereof. In a preferred form of the invention the panel 46 is hinged to panel 36 so that in erected position it has an upward extension 106 acting as a combing.

Top rear panel 51 in its peripheral dimensions is substantially the same as panel 31. It has a transverse middle edge 52 which overlies edge 32, parallel side edges 53 and an inwardly concave rear edge 54. Again, the middle of panel 51 rearward of edges 52 is cut away. Rear seat panel 56 is similar in shape to panel 41 and the edges 57, 58 and 59 correspond to edges 42, 43 and 44, respectively. Similarly, rear gunwale-forming panels 61 are similar to panels 46 and the edges 62, 63, 64 and 65 correspond to the edges 47, 48, 49 and 50, respectively. The stern of the boat (which in erected position is vertical) is preferably closed off by an air-tight membrane 67, preferably of a flexible material so that the stern can fold flat in the collapsed position of the boat. In erected position, membrane 67 is substantially vertical.

Figure 11:
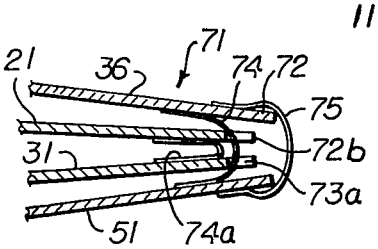
FIG. 11 is a sectional view substantially along line 11—11 of FIG. 10 showing the hinge folded.
Figure 10:
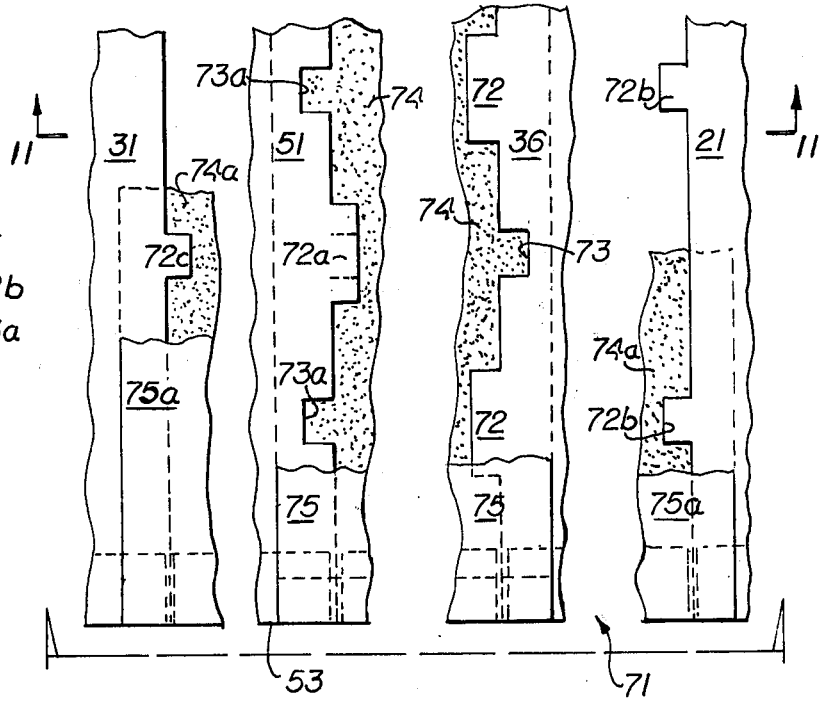
FIG. 10 is an enlarged exploded plan view of a portion of the hinge of the two halves partly broken away to shown internal construction.

Directing attention to FIGS. 10 and 11, where the material of construction is a metal such as aluminum, the panels are rolled so that they tend to be convex about the longitudinal axis of the boat. At the hinge lines of bottom panels 36, 51, the edge is formed irregular. Panel 36 is formed with rectangular projecting tongues 72 and recesses 73 intermediate the tongues, the width of recess 73 being less than the width of tongue 72. Panel 51 is formed with identical tongues **72*a* and recesses 73*a* staggered so that tongue 72*a* is directly opposite recess 73. Panel 21 is formed with tongues 72b of lesser width than recesses 73 immediately underlying tongues 72. Panel 31 is formed with tongues 72*c* identical in width to tongues 72*b* immediately underlying tongues 72*a*. Underlying the adjacent or abutting edges of panels 36 and 51 is adhesive tape 74 suitably cut to permit protrusion of tongues 72*b* and 72*c* and underlying the adjacent or abutting edges of panels 21 and 31 is tape 74*a* (which is not cut away). Overlying the adjacent edges of panels 36 and 51 is tape 75 which is bonded to panels 36 and 51 spaced backward from recesses 73, 73*a* and does not adhere to said edges at the immediate hinge area. Similarly, overlying adjacent edges of panels 21 and 31 is tape 75*a*** which adheres to said panels spaced back from the immediate hinge area.

When the hinge 71 is open (as shown exploded in FIG. 10), each tongue 72 fits on top of panel 51 and overlies recess **73*a* while tongue 72*b* overlies panel 31. Similarly, tongue 72*a* fits over the edge of panel 36 and overlies recess 73 while tongue 72*c* overlies the edge of panel 21. The panels 21, 31, 36, 51 are convex about the longitudinal axis of the boat. Tapes 74 and 74*a* are flat underlying the edges of panels 36–51 and 21–31, respectively. Tapes 75 and 75*a* are also flat, overlying the edges of panels 36–51 and 21–31**, respectively.

When the hinge 71 is to be folded, the convex panels 21, 31, 36, 51 are collapsed flat against their resilient tendency to resume convex shape. The panels are then folded, the tongues **72*b* moving through recesses 73*a* and tongues 72*c* moving through recesses 73. See FIG. 11**.

When the folded hinge is released, the resiliency of the panels tends to enable the panels to unfold to original position and to snap into convex shape.

Figure 3:
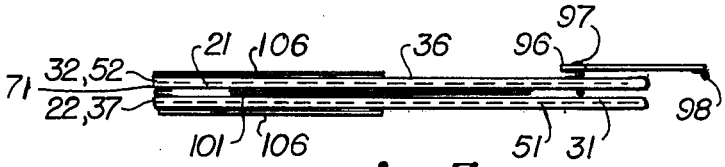
FIG. 3 is an end elevational view of the structure of FIG. 2.
Figure 5:
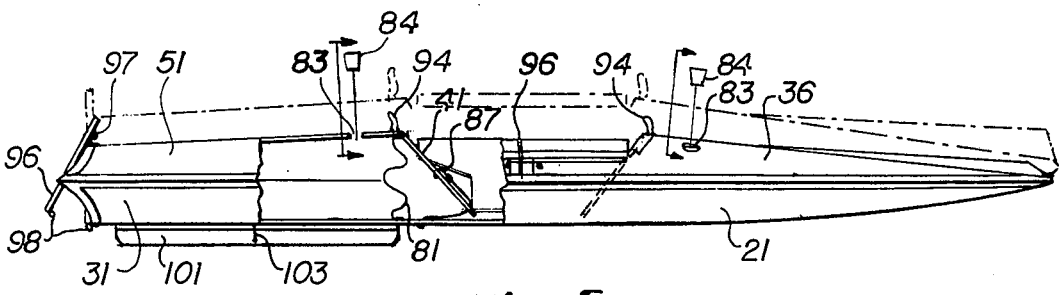
FIG. 5 is a side elevational view partly broken away to reveal internal construction showing the boat partially erected in solid lines and fully erected in dot-and-dash lines.
Figure 6:
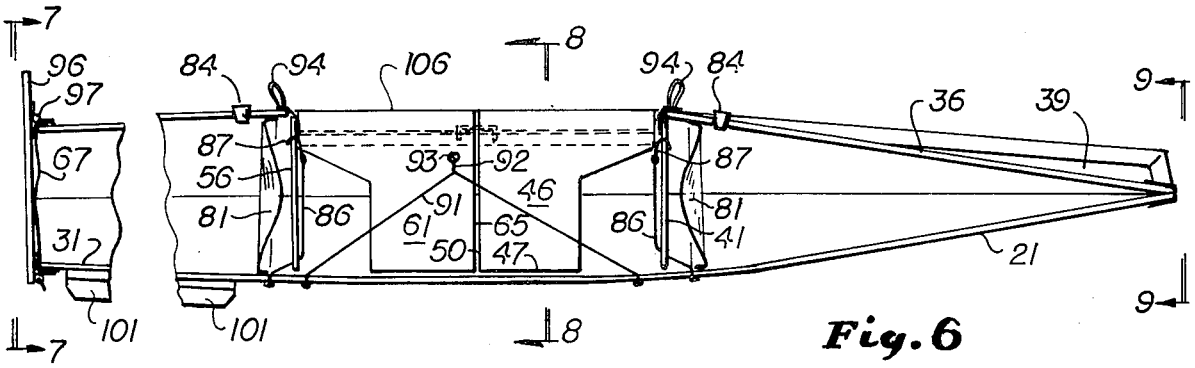
FIG. 6 is a vertical, longitudinal, mid-sectional view partly broken away to conserve space showing the boat fully erected.
Figure 7:
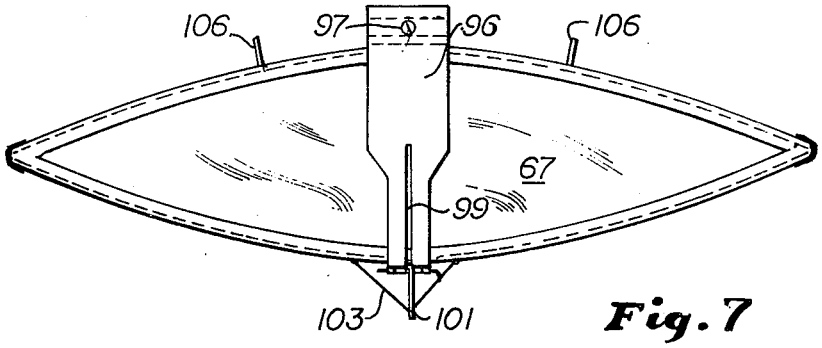
FIG. 7 is an enlarged/rear end elevational view as viewed along the arrow 7—7 of FIG. 6.

As is best shown in FIG. 3, the collapsed boat hinges around hinge 71 to fold into compact condition with the panels 36 and 51 outermost and the panels 21 and 31 innermost. The first step in the erection of the boat is to unfold the front and rear halves about the hinge 71, placing the panels 21 and 31 downmost. Optional latches 76 on the panel 36 adjacent either side and also adjacent edge 50 fit into holes 78 in panel 51 (see FIG. 6) and there secure the front and rear halves of the boat in unfolded position.

A high-strength preferably waterproof adhesive tape 77 is used to tape together in flexible fashion the overlying edges 23 and 38, edges 33 and 53, the edges where panels 24 join each other and join panel 21, the edges where panels 39 join each other and join panel 36, the edge where edge 42 joins panel 36, the line where panel 46 joins panel 36, the edge where panel 56 joins panel 51 and the line where panels 61 join 51. In addition, tape 77 is used to tape together the edges where membrane 67 joins panels 31 and 51.

Figure 2:
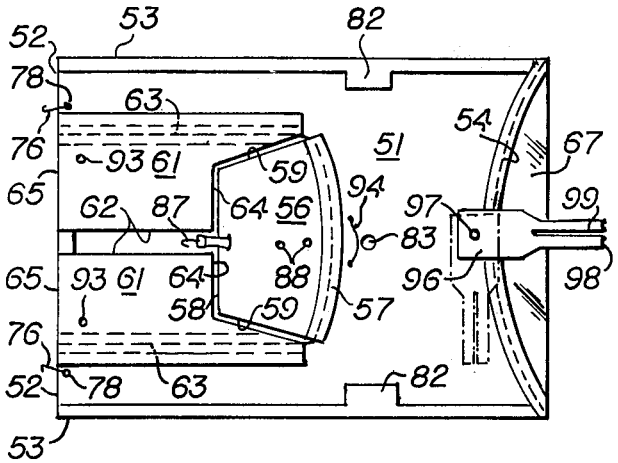
FIG. 2 is a bottom plan view of the boat collapsed and folded as in FIG. 1.
Figure 4:
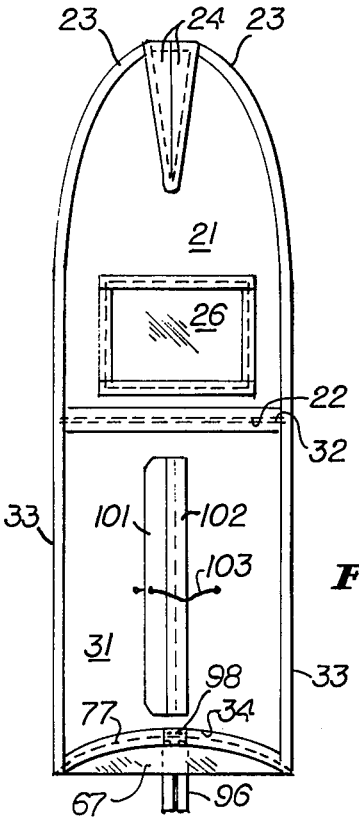
FIG. 4 is a reduced dimension plan view of the bottom of the boat unfolded but still collapsed.

Extending transversely across the boat immediately in front of panel 41 and immediately to the rear of panel 56 is an air-tight membrane 81 of a material such as sheet rubber and having a length equal to the width of the boat and a width equal to the height of the boat in erected position. The edges of the material which form membrane 81 extend out of the side edges of the boat and are folded over. The projecting edges 52 are best shown in FIG. 2 and are taped down to the panel 51 in an air-tight and water-tight manner. Valves are formed in the front and back compartments to permit air to enter ahead of or behind membrane 81 as the boat is being erected and to permit air to be discharged when the boat is being collapsed. The simplest form of valve is illustrated herein consisting of holes 83 in panels 36 and 51 which are closed by rubber stoppers 84. It will be understood that flap valves, or other valve mechanisms, may be substituted.

At front and rear of the cockpit, straps 86 are fixed at their bottom ends to panel 21 or 31 and their upper ends carry hooks 87 which may be hooked into holes 88 as hereinafter described during erection of the boat. Straps 86 in the fully erected position of the boat hold the panels 41 and 56 with bottom edges 58 in firm engagement with panels 31 and 21 and with the panels 41 and 56 slanting downwardly-inwardly of the cockpit. There is considerable tension straps 86 and this forces the boat top and bottom panels to curve and to form a rigid structure.

Figure 8:
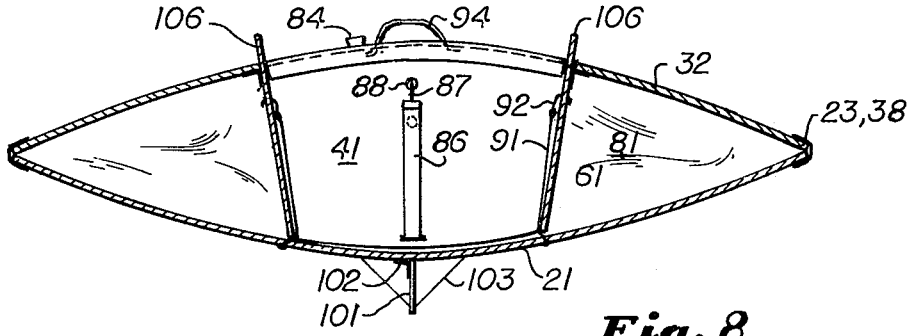
FIG. 8 is a transverse sectional view substantially along the lines 8—8 of FIG. 6.

Cords 91 are also secured to the panels 21 and 31 and are provided with hooks 92 in their middle which hook into holes 93 in panels 61 (or optionally in panels 46). Thus cords 91 on either side of the boat hold the panels 46 and 61 slanted somewhat downwardly-inwardly with the bottom edges 47 and 62 in firm engagement with panels 21 and 31. There is preferably sufficient friction of the bottom edges of panels 46 and 61 against panels 21 and 31 to hold the boat erect. It is a feature of the invention that the gunwale is substantially triangular as best shown in FIG. 8, a shape which rigidifies the boat in its erected position. The combings 106 project above the cockpit to reduce tendency of water to wash over the sides.

In erecting the boat, after it has been unfolded from the position of FIG. 3 to a position where the panels 21 and 31 are downmost, the latches 76 are inserted in the holes 78, thereafter preventing the boat from refolding. The stoppers 84 are removed from the holes 83. If the tendency of the top and bottom to resume original convex shape is not sufficient, the user pulls up on front strap 94 while pushing the bottom edge 43 of panel 41 downwardly and forwardly. The hook 87 of strap 86 is then inserted into hole 88 in panel 41. The procedure is then repeated with panel 56, pulling up on rear strap 94 and pushing down on the panel 86 and inserting the hook 87 in hole 88 of panel 56. Of course the procedure may be reversed with panel 56 being positioned before panel 41.

Thereupon, the user pushes the bottom edges 47 and 62 of the panels 46 and 61 on one side of the boat downwardly and outwardly and latches the hook 92 into hole 93.

Figure 9:
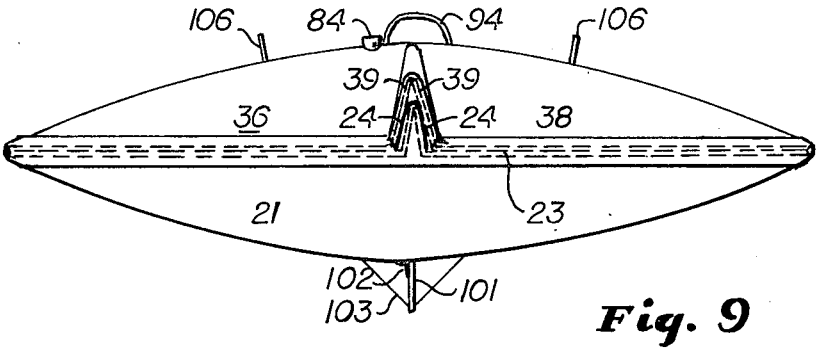
FIG. 9 is a front end elevational view as viewed along the arrows 9—9 of FIG. 6.

The positioning of the various panels which has heretofore been described results in the boat assuming its final shape. The bottom panels 21 and 31 are curved convexly. The bottom prow wedges 24 fold upwardly inside the upwardly folded top prow wedges 39, as is best shown in FIG. 9, and this provides a conical shape to the prow and also rigidifies and strengthens the same. The top panels 36 are also upwardly concave. As the top and bottom panels assume their convex shape, the membrane 67 assumes a vertical position. With the boat thus fully erected the user then inserts the plugs 84 in the holes 83 which provides air-tight buoyancy chambers.

As an optional feature to the boat, a motor mount 96 which is generally paddle shape may be attached by means of pivot 97 to panel 51. In collapsed position, the mount 96 may be turned at right angles to the position shown in FIG. 2 so that it does not project beyond the major configuration of the rear of the boat. However, after the boat is erected, the mount 96 may be pivoted around pivot 97 and in this position it assumes the same vertical position as the stern of the boat. The lower end may be latched to panel 31 by catch 98. An outboard motor may be attached to mount 96 and preferably a bifurcation 99 is formed in mount 96 to receive a bolt attached to the motor.

Figure 12:
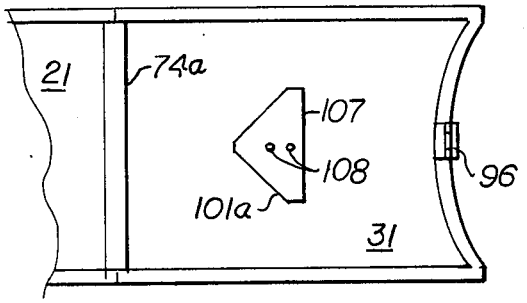
FIG. 12 is a fragmentary bottom plan of a boat having a modified keel.
Figure 14:
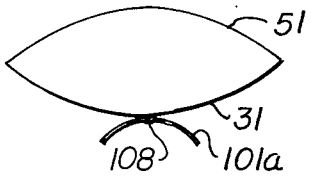
FIG. 14 is a schematic rear elevation of the modification of FIG. 12.
Figure 13:
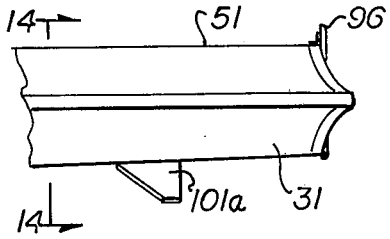
FIG. 13 is a fragmentary side elevation of the structure of FIG. 12.

As a further optional feature of the invention, a keel 101 may be fastened to bottom panel 31 by means of hinge 102. The keel 101 is self-erecting by reason of the flexible nature of hinge 102 which is of a tape similar to tape 77 and the straight edge of keel 101. Ties 103 hold the keel 101 vertical. FIGS. 12–14 illustrate a keel 101*a* which is an alternate to the keel shown in the preceding description. Keel 101*a* is preferably of sheet metal and has, in plan, the shape of an isosceles triangle with a transverse base 107 at the rear and forwardlyinwardly converging sides. Rivets 108 or other fasteners attach the keel to the midpoint of panel 31. The keel assumes a downward curved shape best shown in FIG. 14 when the boat is erected. When the boat is collapsed the keel folds flat.

What is claimed is:

1. A collapsible boat comprising a flexible top having front and rear top panels, a flexible bottom having front and rear bottom panels, first transverse hinge means hinging together and permanently securing against detachment said front and rear top panels, second transverse hinge means hinging together and permanently securing against detachment said front and rear bottom panels, whereby when said boat is collapsed it may be folded in half at said transverse hinge means, said top and bottom comprising a prow, a stern and sides, seal means sealing the peripheral edges of said top and bottom panels together, said top cut away for a cockpit opening and having longitudinal edges, and gunwale panels hinged to said longitudinal edges about third hinge means extending longitudinally of said boat, said gunwale panels being depressible to approximately upright position, the height of said gunwale panels relative to said third hinge means causing said top and bottom to be forced apart from each other, said top and bottom thereby flexing so that said top and bottom are outwardly convex and having an axis of curvature extending longitudinally of said boat.

2. A boat according to claim 1 which further comprises a flexible stern membrane joining the rear edges of said top and bottom rear panels said membrane assuming substantially upright position when said top and bottom are in convex shape.

3. A boat according to claim 1 in which said top front and rear panels have transverse arcuate edges at said cockpit and which further comprises front and rear backrest panels hinged to said transverse edges by fourth hinge means along said arcuate edges, the height of said backrest panels causing said top and bottom front and rear panels to flex to outward convex shape about a longitudinal axis.

4. A boat according to claim 1 which further comprises at least one transverse flexible membrane sealed to said top and bottom longitudinally offset relative to said cockpit opening, said top formed with an aperture, and a plug for said aperture, said membrane sealing off a buoyancy chamber in said boat.

5. A boat according to claim 1 in which said gunwale panels in upright position have their upper edges above the level of said top to form a coaming.

6. A boat according to claim 1 which further comprises a flexible substantially triangular keel and means fastening said keel to said bottom, whereby, when said bottom assumes convex shape, said keel flexes to downward concave shape.

7. A collapsible boat comprising a flexible top, a flexible bottom, said top and bottom comprising a prow, a stern and sides, seal means sealing the peripheral edges of said top and bottom together, said top cut away for a cockpit opening and having longitudinal edges, and gunwale panels hinged to said longitudinal edges, said gunwale panels being depressible to approximately upright position and when depressed forcing said top and bottom apart, said top and bottom flexing to convex shape, said top and bottom each being formed with a flexible, rearward tapering pleat at the front and said top and bottom curve inward at the front to form a prow, said pleats folding upward so that said top and bottom curve into conical shape at the prow when said top and bottom assume convex shape.

8. A collapsible boat comprising a flexible top, a flexible bottom, said top and bottom comprising a prow, a stern and sides, seal means sealing the peripheral edges of said top and bottom together, said top cut away for a cockpit opening and having longitudinal edges, and gunwale panels hinged to said longitudinal edges, said gunwale panels being depressible to approximately upright position and when depressed forcing said top and bottom apart, said top and bottom flexing to convex shape, said top and bottom each being formed of front and rear panels and hinge means extending transversely and hinging said panels together at abutting edges of said front and rear panels, whereby when said boat is collapsed it may be folded in half, said abutting edge of said top front panel having spaced first tongues and first recesses intermediate said tongues, said top rear panel having second tongues opposite said first recesses and second recesses opposite said first tongues, said first tongues being wider than said first recesses, said second tongues being wider than said first recesses, said abutting edge of said bottom front panel having third tongues underlying said first tongues and being of a width less than said second recesses, said bottom rear panel having fourth tongues underlying said second tongues and having a width less than said first recesses and which further comprises first tape connecting the undersides of said top front and rear panels and formed with slits for protrusion of said third and fourth tongues, second tape connecting the undersides of said bottom front and rear panels and third tape interconnecting the outsides of said top front and rear panels.

* * * * *